United States Patent [19]

Iwasaki et al.

[11] Patent Number: 4,782,749

[45] Date of Patent: Nov. 8, 1988

[54] SCREW PRESS WITH AN ACTUATOR

[75] Inventors: Shigeo Iwasaki; Hiroshi Haguchi; Kengo Ujihara, all of Okayama, Japan

[73] Assignee: Kabushiki Kaisha Mitsuishi Fukai Tekkosho, Okayama, Japan

[21] Appl. No.: 891,913

[22] Filed: Aug. 1, 1986

[30] Foreign Application Priority Data

Aug. 5, 1985 [JP] Japan ..... 60-171092
Aug. 5, 1985 [JP] Japan ..... 60-171093

[51] Int. Cl.[4] ..... B30B 1/18

[52] U.S. Cl. ..... 100/271; 100/289; 72/454

[58] Field of Search ..... 100/238, 289, 270, 271; 72/454; 83/631; 425/73

[56] References Cited

U.S. PATENT DOCUMENTS

| | | | |
|---|---|---|---|
| 3,035,514 | 5/1962 | Harvanek | 100/289 X |
| 3,376,728 | 4/1968 | Nemessanyi | 100/289 X |
| 3,595,163 | 7/1971 | Baumann | 100/270 |
| 3,640,210 | 2/1972 | Georg | 100/270 X |
| 3,842,652 | 10/1974 | Yonezawa et al. | 100/289 X |
| 4,064,733 | 12/1977 | Grigorenko et al. | 100/289 X |
| 4,417,864 | 11/1983 | Shigeo et al. | 425/73 |
| 4,606,217 | 8/1986 | Schiller et al. | 100/289 X |

*Primary Examiner*—Andrew M. Falik
*Attorney, Agent, or Firm*—Armstrong, Nikaido, Marmelstein & Kubovcik

[57] ABSTRACT

A screw press comprises an actuator for producing a thrust parallel to an axis of a screw spindle so that by the use of the thrust the screw spindle is axially moved relative to a female screw which is threadably connected with the screw spindle, whereby the screw spindle is rotatably driven.

2 Claims, 3 Drawing Sheets

(PRIOR ART)

SCREW PRESS WITH AN ACTUATOR

BACKGROUND OF THE INVENTION

1. Field of the Invention

The present invention relates to a compaction apparatus utilizing an inertia force of a flywheel, and more particularly to a screw press.

2. Description of the Prior Art

In recent years, during compaction of a refractory brick, high density compression is required. In this connection, the applicant of the present application has proposed a hydraulic compound press with pre-pressing using a hydraulic cylinder. A vacuum type brick compaction apparatus is provided with a soft skirt, as disclosed in Japanese Patent Publication No. 58-44054.

However, such a conventional type of friction press does not have a highly rated performance.

The conventional friction press has a construction as shown in FIG. 5. A screw spindle 31 is supported by a frame 30 through a female screw thereof so as to be moved up and down. The screw spindle 31 is connected to a ram 34 at its lower end portion so the ram moves up and down along guide rails. A punch 32 is mounted on a lower end of the ram 34 to conduct a compaction operation of the refractory brick in cooperation with a die 33 mounted on the frame.

Mounted on an upper end portion of the screw spindle is a flywheel 35 on an outer periphery of which is provided a leather belt 36. A pair of friction plates 39 are mounted on a counter shaft 38 which is driven by a motor 37. The counter shaft 38 is slidably driven by an actuator 40 so that each of the friction plates 39 is alternately brought into contact with the flywheel 35, whereby the flywheel 35 is rotated in either a forward or reverse direction so as to move the screw spindle 38 up or down.

In the conventional friction press described above, rotation of the flywheel, i.e., pressing operation is conducted through the leather belt 36 so that the leather belt 36 must be monitored by an operator whereby the following problems can occur:

(1) The material of the leather belt 36, which is usually cowhide reinforced with nylon, is not stable in quality. For example, in many cases, the hide varies in length according to the weather variations. Also the material changes in quality under the influence of frictional heat in a lengthy operation which causes the hide to break. Thus is is necessary for the operator to continually check the leather belt 36.

When the leather belt 36 is broken during operation, it is necessary to replace the broken belt with a new one immediately in order to avoid a serious accident. Consequently, the leather belt 36 is usually replaced at intervals of 20 to 30 days. However, even when this replacement is conducted, the operator may still be uncertain that the belt won't break. In addition, it is necessary for the operator to climb to the top section of the press every day before operation to check and tighten the leather belt 36, which requires extra time.

(2) Since the counter shaft 38 rotates above the flywheel 35, there is a possibility that the flywheel 35 will collide against the counter shaft 38 when the flywheel 35 is not sufficiently braked.

(3) The forward and reverse rotations of the flywheel 35 depend only on the frictional force acting between the hide and the friction plate 39. Thus, it becomes impossible to eliminate a time lag, whereby an extra stroke is needed which leads to a longer compaction time. Particularly, as is in recent cases, when a method is is employed that requires re-pressing at least 10 times, it is extremely important to reduce the compaction time.

(4) Since the temperature of the hide increases due to friction, it is not possible to conduct a lengthy operation, and it is necessary to provide down-time in order to cool the hide.

Thus, since it is necessary to check the most important operating mechanism manually, the above-mentioned problems constitute obstacles in developing an unmanned compaction system. Further, such an important mechanism if automatically controlled is not reliable. Since the most important compaction mechanism is controlled in an unstable manner, the press is not reliable.

SUMMARY OF THE INVENTION

It is an object of the present invention to resolve the above-mentioned problems and to provide a novel screw press in which an actuator gives a screw spindle a thrust.

More particularly, it is object of the present invention to provide a screw press comprising a screw spindle rotatably mounted on a frame of the press. A flywheel is mounted on an upper end of the screw spindle. A ram is provided in the frame in a slidable manner. A female screw is integrally mounted on the ram. An actuator gives the ram a thrust parallel to an axis of the screw spindle, whereby the screw spindle, which is threadably connected to the female screw, is rotatably driven through an up-and-down movement of the ram.

It is another object of the present invention to provide a screw press comprising a female screw fixed to a frame of the press. A screw spindle is threadably connected to the female screw. A flywheel is mounted on an upper end of the screw spindle. A ram is disposed under the screw spindle in a vertically slidably movable manner. A punch is fixed to a lower portion of ram. The improvement in press further comprises an actuator which produces a thrust in parallel to an axis of the screw spindle provided in the frame of the press. A driving holder transmits axial thrust produced by the actuator to the screw spindle through a bearing.

In the above press, it is possible to provide another, i.e., a second actuator for rotatably driving the screw spindle, whereby only the ram is axially driven by the use of the second actuator to conduct a pre-pressing operation.

The actuator of the screw press of the present invention may be a type of an actuator for moving a rod up or down, for example such as a hydraulic cylinder unit, a screw type power cylinder or the like.

The present invention is provided with the following features:

(1) Only the flywheel projects above the upper portion of the frame so that a counter shaft and friction plates are not required to be provided above the flywheel in contrast with the conventional friction type impact press. Consequently, it is possible to simplify the construction of the press of the present invention. In the press of the present invention, therefore, it is possible to select the stroke of the press at will, while it is also possible to easily inspect and maintain because the main movable components thereof can be disposed under the frame.

(2) The hide belt is not required thereby eliminating the inspection, tightening and replacement thereof, whereby it is possible to increase the working efficiency of the press.

(3) Since it is possible to conduct the forward and reverse rotations of the flywheel using the actuator which can swiftly changed its operational direction, the impact cycle of the compaction is performed at a high speed so that the compaction speed is increased.

(4) Since any of the pressing force, speed and stroke are proportional to the operation force, speed and stroke of the actuator, it is possible to control the impact energy by servocontrolling the actuator.

Namely, it is possible to conduct the presetting of the impact energy which is not possible in the friction press.

(5) Since a large capacity driving motor for rotating the friction plate is not required, it is possible to save power.

(6) This type of the compaction press is a compound press in which there are combined: the impact force produced through the discharge of the rotation energy which is a feature of the friction press; and the stroke, pressing force and speed which are features of the hydraulic (or servo) unit together with its controllable properties. Consequently, such a compound press can perform a high density and high precise compaction operation.

DESCRIPTION OF THE PREFERRED EMBODIMENTS

Figure 1:
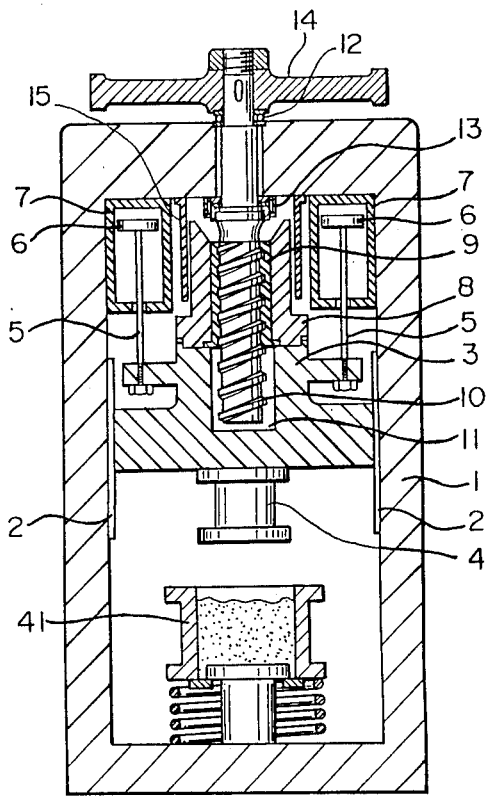
FIG. 1 is a partially broken front sectional view of an embodiment of the present invention.

The present invention will be hereinbelow described with reference to the drawings, wherein the present invention is not limited to these embodiments. In the drawings, like reference numerals identify like parts.

FIG. 1 shows a first embodiment of the present invention, which is a partially sectional front view of the embodiment. Guide rails 2 are provided inside a frame 1 of a screw press of the present invention for slidably guiding a ram 3 of the press. A punch 4 is fixed to a lower surface of the ram 3 for a compaction operation in cooperation with a die 41 which is provided in a lower portion of the fame 1.

A pair of rods 5 are mounted on an upper surface of the ram 3. A piston 6, formed in an upper end of each of the rods 5, is inserted in a hydraulic cylinder 7 which is provided with a pressurized oil supplying port (not shown) at each of its upper and lower ends for receiving the pressurized oil supplied from a hydraulic pressure control unit for moving the piston 6 up or down using the pressurized oil.

On an upper portion of the ram 3 is mounted a female screw holder 8 inside of which is held a female screw 9 which is threadably connected with a screw spindle 10 a lower end of which is inserted in a recess 11 formed in the ram 3.

An upper portion of the screw spindle 10 is supported by a thrust bearing 12 and a thrust bearing unit 13 so that the screw spindle can rotate. Consequently, even when the screw spindle 10 is subjected to upward or downward thrusts, the screw spindle 10 is not axially moved but instead only rotates about the bearing.

On an upper end portion of the screw spindle 10 is mounted a flywheel 14 which accumulates a rotative kinetic energy supplied to the screw spindle 10. An amount of inertia moment of the flywheel 14 is determined by the design in consideration of the power requisite for conducting the pressing operation.

In a lower surface of an upper member of the frame 1, there is mounted a cover 15 for covering the female screw holder 8 in order to prevent dust from entering a space between the female screw 9 and the screw spindle 10.

In operation of the first embodiment of the present invention, FIG. 1 shows a punch 4 in a resting position in which the punch 4 is upwardly separated from the die 41. In this condition, preparation for the compaction operation is completed by supplying the material to the die. Then, the hydraulic control unit (not shown) is actuated to supply the pressurized oil to the upper side of the cylinder 7 so that the piston is moved down, whereby the ram 3 is also moved down through the rod 5. Since the female screw 9 is integrated with the ram 3, the female screw 9 is moved downward together with the ram 3 which forces the screw spindle 10 to rotate. The torque of the screw spindle is received by the flywheel 14 and accumulated in the latter as rotational inertia energy of the spinning flywheel. The inertial energy is instantaneously discharged and supplied to the punch 4 as an impact force as the spinning flywheel continues to rotate the spindle when a front end of the punch 4 reaches the die so that a high density compaction operation is performed. After the compaction, the supply of the pressurized oil is shifted to the lower side of the hydraulic cylinder 7 so that the ram 3 is lifted to return to its resting position.

In the first embodiment of the present invention shown in FIG. 1, by controlling the pressurized oil supply, it is possible to control the piston 6 speed and stroke to precisely control the energy supplied to the flywheel 14. Consequently, it is possible to obtain adequate energy to make it possible to achieve a precise compaction operation.

Figure 2:
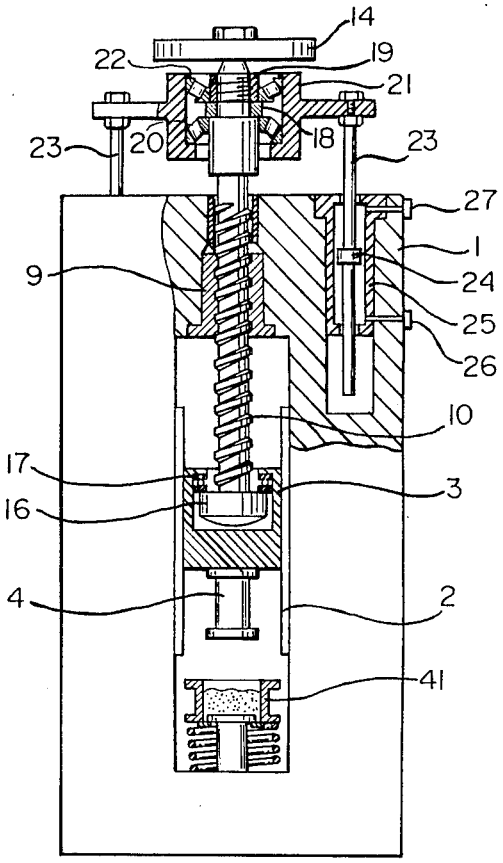
FIG. 2 is a partially broken front sectional view of another embodiment of the present invention.

FIG. 2 is a front view of a second embodiment of the present invention, in which a part of the screw spindle 10 is shown in section. The female screw 9 is fixed to a central portion of the frame 1 of the screw press of the present invention. The female screw 9 has the screw spindle 10 inserted therein in a rotatable manner so as to be threadably connected to the female screw 9. A large diameter portion 16 is formed in a lower end portion of the screw spindle 10. The large diameter portion 16 is mounted in the ram 3 through a thrust bearing 17. Since the ram 3 is slidably engaged with the guide rails 2 provided inside the frame 1, the ram 3 is moved up or down according to the up-and-down movement of the screw spindle 10. The punch 4 is mounted in a lower end of the ram 3. On an upper portion of the screw spindle 10 is mounted a spacer 18 through an inner lock nut 19. The spacer 18 is interposed between a pair of bearings 20 the outer races of which are inserted in an inner bore of a driving holder 21 and fixed to the same holder 21 through an outer lock nut 22.

On opposite ends of the driving holder 21 are mounted a pair of rods 23 each of which is provided with a piston 24 in its central portion. On the other hand, the frame 1 of the screw press is provided with hydraulic cylinders 25 in each of which is inserted the piston 24. In upper and lower ends of the hydraulic cylinder 25 are provided supplying ports 26, 27 of the pressurized oil which drives the piston 24 in the known manner.

The flywheel 14 is mounted on an upper end portion of the screw spindle 10.

In operation of the press shown in FIG. 2, first, the piston 24 is lifted to an upper end position of the cylinder 25, which position is the resting position for the screw press. Namely, the punch 4 is lifted together with the ram 3 so that the materials for the refractory brick is charged into the die 41. After completion of the preparation for compaction operation, the press is operated to supply the pressurized oil to an upper portion port 27 of the cylinder 25, whereby the piston 24 is moved downward so that the driving holder 23 is lowered through the rod 23. As a result, the screw spindle 10 is forcibly moved downward. Since the screw spindle 10 is threadably connected with the female 9, the screw spindle 10 is rotatably driven so that the turning moment of the screw spindle 10 is accumulated in the flywheel 14 as a rotational moment of inertia.

As the screw spindle 10 moves downward, the moment of inertia increases so that the punch 4 is inserted into the die to initiate the compaction, whereby compaction resistance is applied to the punch 4 while the energy accumulated in the flywheel 14 is discharged and converted into a compaction force as the spinning flywheel continues to rotate the spindle to achieve a high density compaction.

After completion of such a compaction, operation, the supply of the pressurized oil is shifted to the side of the port 26 so that the screw spindle 10 and the punch 4 together with the piston 24 are moved upward to return to their resting positions.

In the embodiment shown in FIG. 2, as describe above, since the screw press is driven through the up-and-down movement of the actuator, it is possible to ensure a safe continuous operation of the press to achieve a high density compaction operation.

Figure 3:
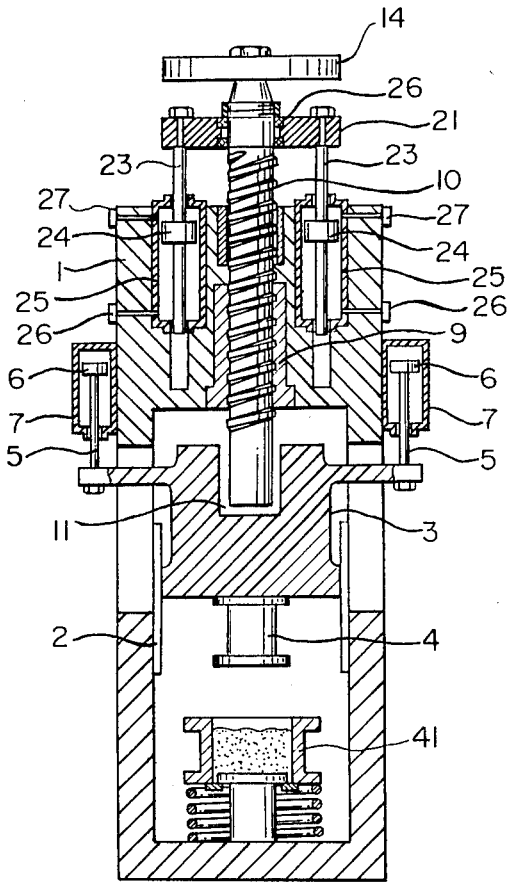
FIG. 3 is a sectional front view of further another embodiment of the present invention.

Next, a third embodiment of the present invention shown in FIG. 3 relates to a compound press in which the screw press of the second embodiment of the invention is compounded with a hydraulic compaction unit. The frame 1 of the compound press is provided with the guide rails 2 which support the ram 3 in a slidable manner. In a lower end portion of the ram 3 is mounted the punch 4 which conducts the compaction operation in cooperation with the die 41.

A pair of the rods 5 are mounted on the ram 3. The piston 6 provided in the rod 5 is inserted in the cylinder 7 provided in the frame 1. Consequently, by supplying the pressurized oil to the cylinder 7, it is possible to move the punch 4 downward to conduct the pre-pressing operation in cooperation with the die 41.

On the other hand, the female screw 9 is fixed to the upper central portion of the frame 1 and threadably connected with the screw spindle 10. A lower end portion of the screw spindle 10 is engaged with the recess 11 formed in the upper surface of the ram 3. An upper portion of the screw spindle 10 is mounted in the driving holder 21 through the bearing 26. A pair of rods 23 are provided in the driving holder 21. The piston 24 formed in the rod 23 is inserted in the hydraulic cylinder 25 provided in the frame 1. The hydraulic ports 26, 27 are provided in the upper and lower ends of the hydraulic cylinder 25 to make it possible that the pressurized oil is selectively supplied.

The flywheel 14 is mounted on the upper end portion of the screw spindle 10.

In operation of the embodiment shown in FIG. 3, the materials for the refractory brick are charged into the die 41 disposed under the frame 1, and then the pressurized oil is supplied to the upper portion of the cylinder 7 so that the ram 3 is moved downward to conduct a pre-pressing operation through the punch 4. After that, the pressurized oil is supplied to the port 27 so that the piston 24 is lowered, whereby the screw spindle 10 is moved downward through the driving holder 21 while being rotated. The rotation energy of the screw spindle 10 is accumulated in the flywheel 14. When the lower end of the screw spindle 10 abuts against the recess 11 in the upper surface of the ram 3, an intense impact force derived from the rotation energy of the flywheel 14 and the pressure of the pressurized oil applied to the screw spindle 10 is transmitted to the ram 3 so that the punch 4 conducts a high density compaction operation.

Immediately after discharge of the impact force onto the ram 3, the reaction of the screw spindle 10 cause the spindle 10 to be moved upward so that a surge pressure is produced in the cylinder 7. However, at this moment, the hydraulic control unit is actuated to return the oil pressure in the cylinder 7 to the neutral condition. The supply of the pressurized oil is then shifted to the port 26 so that the driving holder 21 is returned to an upper end resting position, whereby one cycle of the operation is completed.

According to the screw press of this embodiment, since the main compaction is conducted with the impact force after completion of the pre-pressing operation which is conducted by the use of hydraulic pressure, it is possible to obtain a higher density and high precise shaped compact.

Figure 4:
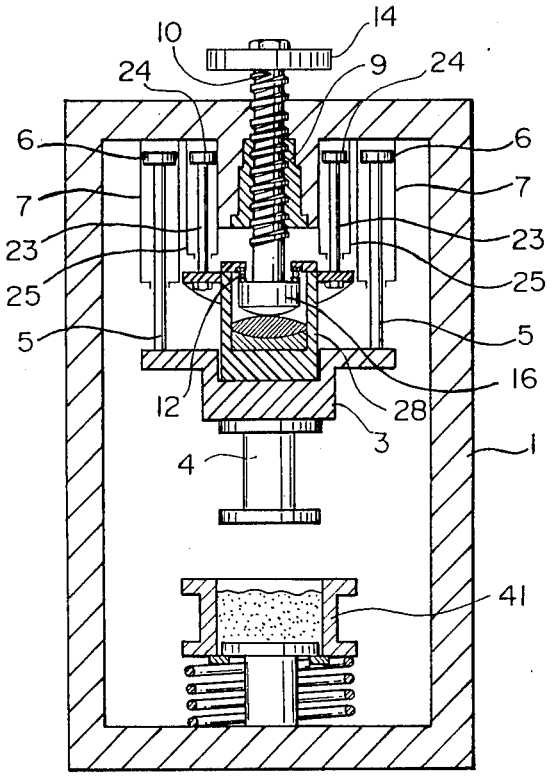
FIG. 4 is a sectional front view of a fourth embodiment of the present invention.
Figure 5:
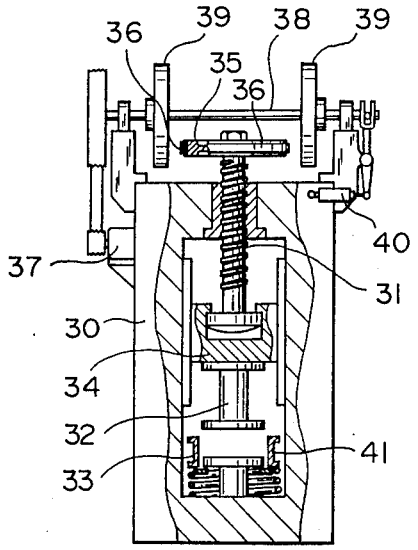
FIG. 5 is a partially broken sectional front view of a conventional friction press.

In the embodiment shown in FIG. 3, although the driving holder 21 is mounted on the upper portion of the screw spindle 10, it is also possible to mount the driving holder 21 in the lower portion of the screw spindle 10 as shown in FIG. 4. Namely, the ram 3 is slidably supported by the frame 1. The punch 4 is mounted in the lower end of the ram 3. The piston 6, formed in the upper portion of each of the pair of the rods 5 which are embedded in the upper surface portion of the ram 3, is inserted in the cylinder 7 which is the cylinder for conducting the pre-pressing operation.

On the other hand, the female screw 9 mounted in the upper member of the fame 1 is threadably connected with the screw spindle 10. On an upper end portion of of the screw press 10 is mounted the flywheel 14. A large diameter portion 16 is formed in the lower end portion of the screw spindle 10. The portion 16 is inserted in the recess of a pressing block 28. An upper surface of the portion 16 is held by the thrust bearing 12. A pair of rods 23 are embedded in the pressing block 28. An upper end of each rod 23 is shaped into a piston 24 which is inserted in a cylinder 25.

Consequently, in the press shown in FIG. 4, after completion of the pre-pressing by means of the punch 4 which is driven by the pre-pressing cylinder 7, the cyclinder 25 is driven to lower the pressing block 28 to apply an impact force to the punch 4 through the screw spindle 10 and the flywheel 14.

In the embodiment shown in FIG. 4, the cylinder 25, acting as an actuator, is provided inside the frame so that a driving force is applied to the lower end of the screw spindle 10, whereby it is it is possible to decrease the volume of the press and to make the maintenance thereof easy.

What is claimed is:

1. A screw press comprising:

a frame;

a female screw fixed to said frame;

a screw spindle being threadably engaged with said female screw to be movable up and down, said screw spindle being provided with a flywheel at an upper end;

a ram being slidably mounted in said frame under said screw spindle, said ram being provided with a punch at a lower end;

an actuator for producing an axial thrust in a direction parallel to an axial direction of said screw spindle provided in said frame, said screw spindle being rotatably driven when moved up and down by said actuator; and a driving holder in which said screw spindle is rotatably supported by a bearing while not axially movable in said bearing, said driving holder being connected with said actuator to transmit said axial thrust produced by said actuator to said screw spindle so that said screw spindle is axially moved, said flywheel being exclusively rotatably driven by said screw spindle connected with said female screw when said ram moves downward, said flywheel having a force of inertia accumulated during the rotation of said flywheel, said force of inertia being applied as an impact to said punch through said screw spindle and said ram when said punch abuts a die and said ram is substantially stopped in a downward movement.

2. The screw press as set forth in claim 1, wherein there is provided a second actuator for rotatably driving said screw spindle, whereby only said ram is axially driven by the use of said second actuator to conduct a pre-pressing operation.

* * * * *